United States Patent [19]

Mellick

[11] Patent Number: 4,867,426

[45] Date of Patent: Sep. 19, 1989

[54] ARROW HELD FLETCHING JIG

[76] Inventor: Gary D. Mellick, 5941 Hwy. 24, Moxee, Wash. 98936

[21] Appl. No.: 227,240

[22] Filed: Aug. 2, 1988

[51] Int. Cl.[4] ..... B25B 1/20

[52] U.S. Cl. ..... 269/38

[58] Field of Search ..... 269/287, 38

[56] References Cited

U.S. PATENT DOCUMENTS

| | | | |
|---|---|---|---|
| 1,945,416 | 1/1934 | Birchall | 269/38 |
| 4,009,875 | 3/1977 | Erlandson . | |
| 4,366,022 | 12/1982 | Coffman . | |
| 4,653,738 | 3/1987 | York | 269/38 |

FOREIGN PATENT DOCUMENTS

| | | | |
|---|---|---|---|
| 776841 | 6/1957 | United Kingdom | 269/38 |

*Primary Examiner*—Robert C. Watson

*Attorney, Agent, or Firm*—Roy E. Mattern, Jr.

[57] ABSTRACT

An archer's fletching jig is supported by an arrow, on which pre-shaped fletching material is to be arranged at preselected radial spacings of either four fletches at 90 degrees, three fletches at 120 degrees, or four fletches at the combined 75 degrees and 105 degrees, and then to be accurately adhered on the arrow shaft. Different molded part embodiments of these arrow held fletching jigs, each arranged for a specific radial spacing of fletches, all have a respective arrow upper end cap. The latter has a centrally located upstanding nock alignment pin, and the former has a centrally located hole to surround an arrow shaft. On any flat surface, the arrow lower end cap is placed to receive and to hold the nock of an upright positioned shaft of an arrow. Then respective clamp receivers are selectively spaced about the upstanding arrow shaft, and then depending ends are tapered to match a tapered upstanding receiving interior volume of the arrow lower end cap. The selective clamp receivers each have, near the top and near the bottom, a partial vee shaped recess on the interior side to abut an arrow shaft. When the arrow upper end cap is then subsequently lowered in place over their upstanding ends, the clamp receivers are held in place about the arrow shaft, with their bottoms continuously held in place by the arrow lower end cap. Then selected fletch clamps, each filled with a fletch material, having a subsequently applied adhesive, are moved into contact with the arrow shaft, while guided and held in a vertical slot of a fletch clamp. In another embodiment, the clamp receivers have a common integral end and radially expandable other ends, which, when positioned together, are held by a locking ring.

19 Claims, 5 Drawing Sheets

FIG. 4
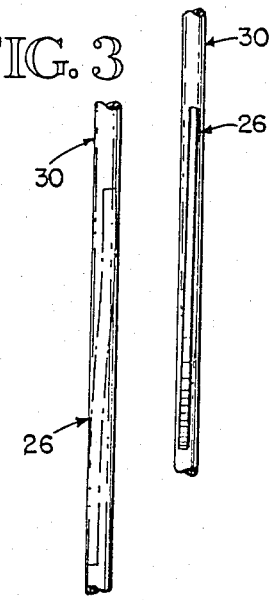
FIG. 3
FIG. 5
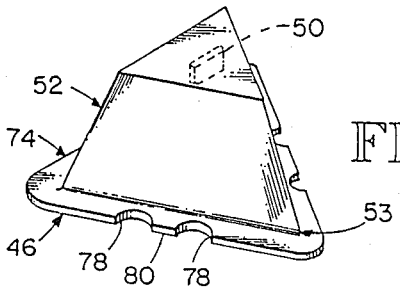
FIG. 7
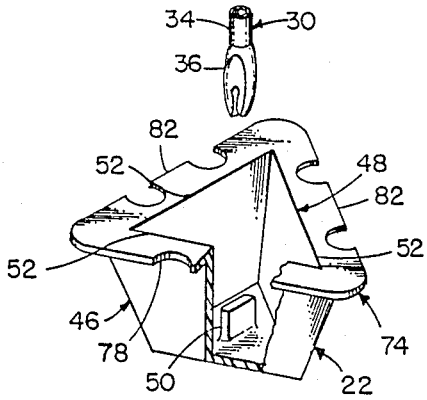
FIG. 6

FIG. 12
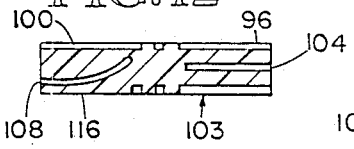
FIG. 13
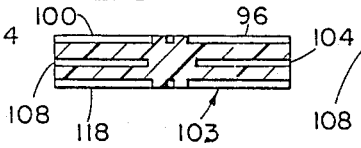
FIG. 14
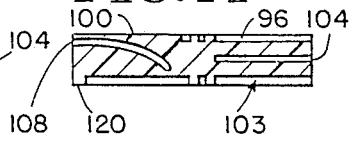
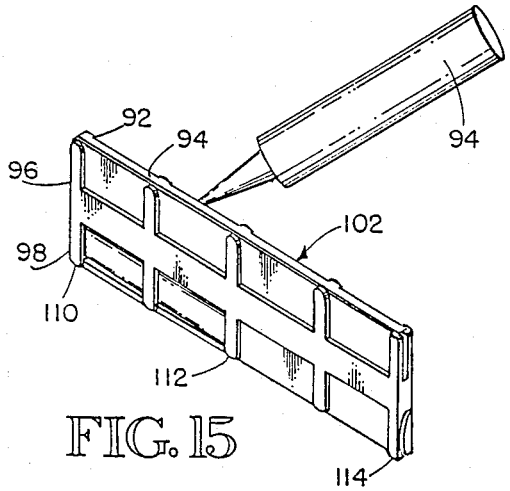
FIG. 15
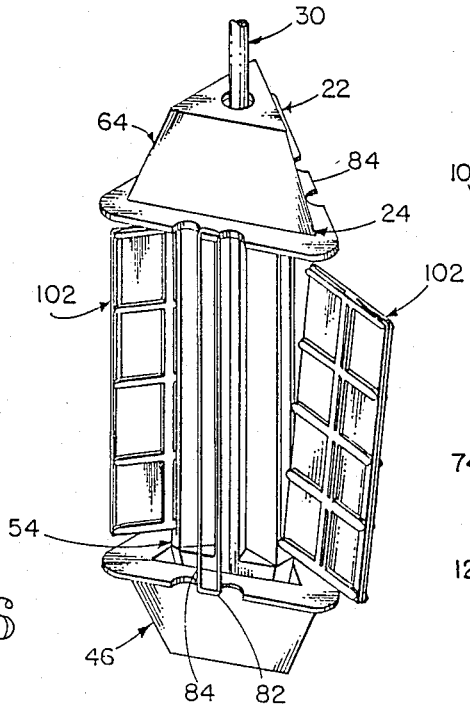
FIG. 16
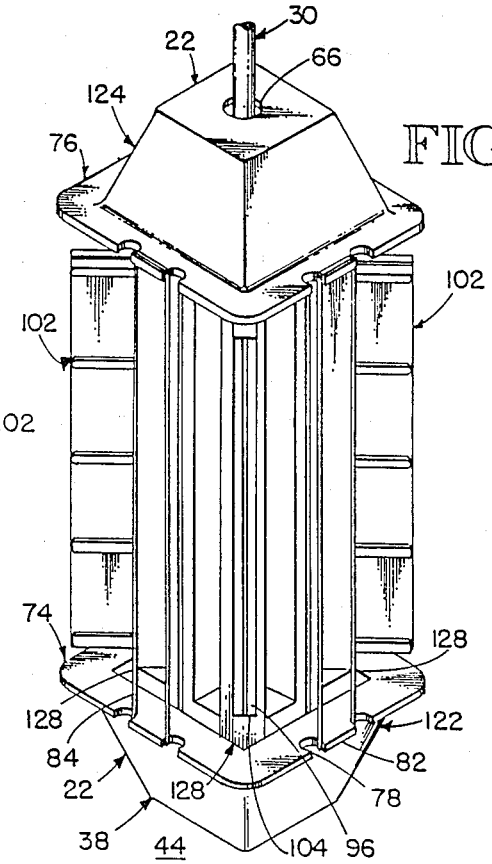
FIG. 17

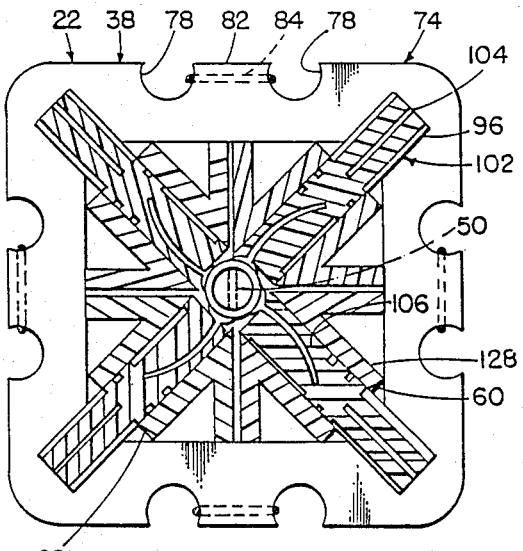
FIG. 18
FIG. 19
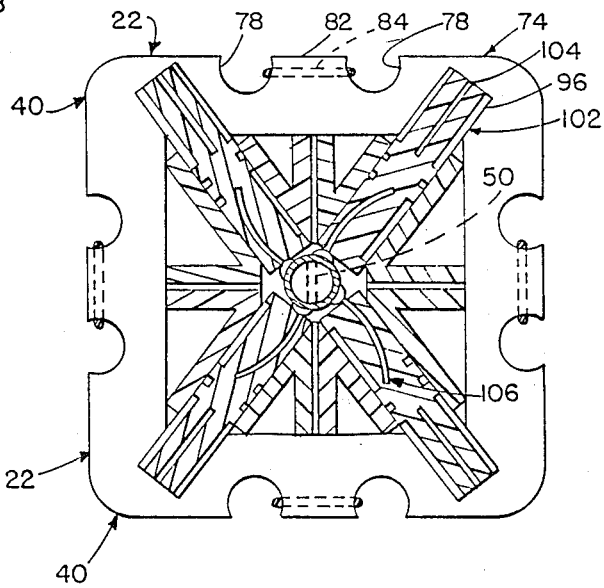
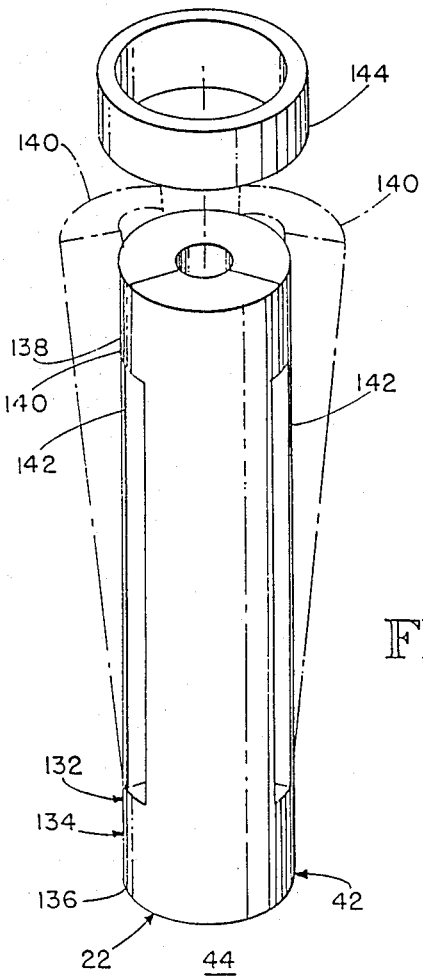
FIG. 20

ARROW HELD FLETCHING JIG

BACKGROUND

The fletching of arrows is done by mechanized apparatus such as disclosed by Thomas E. Coffman in his U.S. Pat. No. 4,366,022 of 1982, using a comparatively higher cost and more complex apparatus, which supports and moves arrow shafts as the fletching material is adhered to the arrow shafts in one time period. In contrast, Roger S. Erlandson in his U.S. Pat. No. 4,009,875 of 1977, illustrates and discloses his comparatively lower cost and less complex, fletching jig, which supports an arrow and permits the fletching of two or more arrow fletches at essentially one time period on a selected arrow shaft, when utilizing multiple fletch fletch arrangements.

In industry catalogs, various fletching tools are illustrated which supports arrow shafts, either one at a time, or side by side in groups, and either in linear or circular arrangements. Generally a fletching material of preselected contour is positioned and adhered at one locale on the arrow shaft in a then selected alignment contour and so held for a while. Then the arrow shaft is repositioned, and another preselected portion of fletching material is positioned and adhered. This sequence is repeated, until the selected number of portions of fletching material are adhered to the arrow shaft, providing all the features or fletches of the arrow.

These prior tools and mechanisms served their purposes very well, yet there remained a need for a comparatively low cost tool, i.e. a fletching jig, to be used at any locale, in the countryside, in a shop, or in a home, where a flat surface was available, to accurately adhere all the selected fletching material to an arrow shaft of a selected diameter, at essentially one time, in reference to the simultaneous adhering time of the fletches on the arrow shaft.

SUMMARY

For the individual archer who prefers to initially adhere fletching material to her or to his arrow shafts, and/or to replace fletching mateiral, in selected locations about an arrow shaft, and in selected vane contours, this archer's fletching jig is provided for use anywhere where a flat surface is available as this fletching jig is essentially supported by the arrow which is to receive the fletches.

Each embodiment accommodates arrows having different shaft diameters. However, there are different embodiments depending on the selection of the fletch placements, and whether or not all components thereof are to be molded parts.

On a selected flat service found in the countryside, on a vehicle, in a shop, or in a home, in reference to the use of all molded parts an arrow lower end cap with an upstanding nock alignment pin, also referred to as the nock end cap is placed to receive the nock of an upright positioned shaft of an arrow, and thereafter to hold the arrow shaft upright. Then, depending on the embodiment selected, in reference to the number and spacing of fletches, respective upright positioned clamp receivers are selectively spaced about the upstanding arrow shaft.

The depending ends of these clamp receivers are tapered to match a tapered upstanding receiving interior volume of an arrow lower end cap, and they are lowered into this arrow lower end cap. The upstanding ends of these clamp receives are also like tapered to match the tapered depending interior volume of an arrow upper end cap, also known as the point end cap, which has a centered hole to receive an arrow shaft. Upon the lowering of the arrow upper end cap along the arrow shaft, and over these upstanding ends, the selected clamp receivers are held in place about the selected arrow shaft, and between these arrow upper and lower end caps, i.e. between the pointed end and the nock end caps. Preferably the angled, or tapered surfaces are made to have a rough surface. Thereafter the interfitting of these tapered rough surfaces holds this arrow held fletching jig together. At some times elastic bands are stretched between the point end cap and the nock end clamp to further insure the assembly of the arrow held fletching jig.

In each embodiment, the interiors of these clamp receivers are formed to accommodate arrow shafts of different diameters.

While this arrow shaft or arrow supported subassembly of the arrow, the clamp receivers, and the arrow caps remain positioned on the selected flat surface, respective selected fletch clamps are filled with a respective selected fletch material cut along a selected contour. Then an adhesive is applied along the edges of the fletch materials that are to be secured adjacent the arrow shaft. Thereafter, the fletch clamps, so filled with fletching material, are moved into respective vertical slots of the respective clamp receivers, so the adhesive covered edges are firmly placed in contact with the arrow shaft in the preselected position determined by the selected embodiment of this archer's fletching jig.

Inscribed on the arrow lower end cap, also referred to as the nock locator cap or the nock end cap, is a small arrow, which designates the so called cock fletch position.

After a presetting time, determined in reference to the adhesive being used, the fletch clamps are removed. Then the arrow upper end cap is raised upwardly to clear the upper ends of the clamp receivers and the arrow shaft. These ends are then moved radially outwardly and thereafter the arrow shaft with the fletches or fletchings in place is lifted clear of this arrow held fletching jig.

In reference to hand tooled prototypes, the fletch clamp receivers at one end are integrally held together, and their other ends are moved radially outwardly to clear the positioned fletches, when the arrow shaft is removed from the arrow held fletching jig.

DESCRIPTION OF THE DRAWINGS

The arrow held fletching jig is first fully illustrated in the drawings, in reference to a three fletch equally spaced molded part embodiment, and illustrated in part with reference to four fletch molded part embodiments of respective selected spacings of the fletches on the shafts of arrows, and then in reference to a prototype which was made via tooling procedures, wherein.

FIG. 3 is a partial view of an arrow shaft showing how fletching material of selected size and contour has been applied adhesively in a right helical pattern for a fletch, using this arrow held fletching jig;

FIG. 4 is like FIG. 3, but showing the straight pattern for a fletch;

FIG. 5 is like FIGS. 3 and 4, but showing the left helical pattern for a fletch;

FIG. 6 is a perspective view, with a portion broken away, of the arrow lower end cap, also referred to as the nock locator cap, or nock end cap, showing the nock alignment and receiving upstanding pin or tab which accommodates nocks of various sizes;

FIG. 7 is a perspective view of the nock locator cap, in respect to the underside thereof, on which there is an inscribed cock fletch locator arrow;

FIG. 12 is a cross sectional view, taken along line 12—12 of FIG. 8, in a view similar to FIG. 9, but showin how this fletching material clamp has a left helical groove along one edge portion thereof, and a straight groove along the outer edge portion thereof;

FIG. 13 is a cross sectional view, taken along line 13—13 of FIG. 8, in a view similar to FIG. 10, indicating how the fletching material clamp, shown in FIG. 12, appears next or at the mid section, where the grooves in cross section appear alike, as though both were straight grooves;

FIG. 14 is a cross sectional view, taken along line 14—14 of FIG. 8 indicating how the fletching material clamp, shown in FIGS. 12 and 13, appears nearer the bottom thereof, in respect to the left helical groove along one edge portion thereof, and a straight groove along the outer edge portion thereof;

FIG. 15 is a perspective view of fletching material after the insertion thereof in a clamp, receiving an adhesive;

FIG. 16 is a partial perspective view showing the initial insertion of clamp in a clamp receiver, after the application of the adhesive on the fletching material;

FIG. 17 is a perspective view, similar to FIG. 1, but showing however, another embodiment used in securing the fletch material, so four equally spaced fletches are positioned on the shaft of the arrow;

FIG. 18 is a cross sectional view taken on line 18—18 of FIG. 17, looking down toward the bottom of the arrow held fletching jig;

FIG. 19 is a cross sectional view, similar to FIG. 18, but showing, however, the arrangement of four clamp receivers, so the clamp receiving slots thereof position the fletching material, so the fletches are spaced on the arrow shaft in reference to two spaces determined by 105 degrees, and to two spaces determined by 75 degrees; and FIG. 20 is a partially exploded perspective view of the components of the hand made prototype of the arrow supported fletching jig, which served as the basis for the creation of the molded parts embodiment illustrated in FIGS. 1, 8 and 17.

DESCRIPTION OF THE PREFERRED EMBODIMENT

An Introduction to the Selected Embodiments

Figure 1:
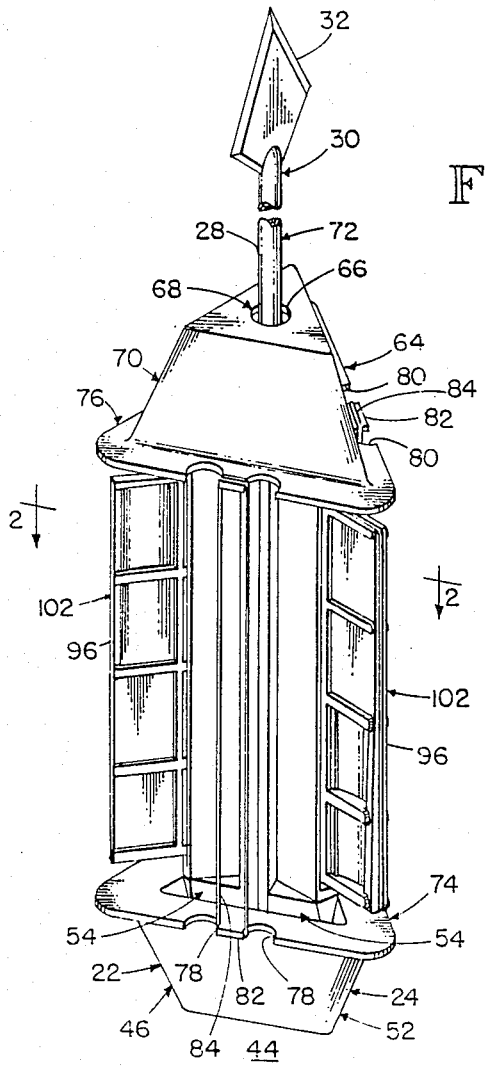
FIG. 1 is a perspective view, with a portion of the arrow shaft removed, to illustrate how an arrow shaft or arrow supports the assembled surrounding arrow held fletching jig on a level surface, wherever such a level surface may be found.

This arrow held fletching FIG. 22 is shown in FIG. 1 of the drawings in an embodiment 24 of molded parts, used in securing three fletches 26 at three qual spaces about a shaft 28 of an arrow 30, having a pointed end 32, a nock end 34, and a nock 36, the spaces being determined by 120 degree arcs. In FIG. 17, an embodiment 38 is shown, wherein the spaces between the four fletches 26, are determined by 90 degree arcs. In FIG. 19, an embodiment 40 is shown, wherein the spaces between the four fletches 26 are spaced on the arrow shaft 28 in reference to two spaces determined by 105 degrees, and to two spaces determined by 75 degrees. In FIG. 20, a hand made prototype 42 of this arrow held fletching jig 22 is illustrated. This prototype 42 served as the basis for designing the other embodiments which are composed of molded components. In the descriptions to follow the use of the various embodiments is discussed in reference to the upright position of the arrow shaft and the arrow held fletching jig. Some persons, however, will use this arrow held fletching jig about an arrow, which is in the horizontal position.

The Objectives Gained by Using the Various Embodiments of the Arrow Held Fletching Jig At a comparatively low cost an archer's fletching jig 22 is available, which is lightweight, which occupies a comparatively small space, and which is essentially supported by an arrow shaft 28. The assembly of this fletching jig 22 about an arrow shaft 28 may be undertaken at any location, where a small area level surface 44 may be found. All fletches 26 to be secured to an arrow shaft 28 are accurately pre-positioned. The fletches 26 so remain, during an essentially one fletch adhesive curing time, when all the fletches are being secured essentially at one time. Each embodiment may be used with arrow shafts 28 of different diameters, and with arrows having different nocks 36. Each embodiment may be used to place the fletches 26 on the arrow shafts in one of three selected configurations. In FIG. 3, a partial view of an arrow shaft 28 shows a fletch 26 secured to the shaft 28 in a right helical pattern. In FIG. 4, the fletch 26 is secured in a straight pattern. In FIG. 5, the fletch 26 is secured in a left helical pattern.

The Three Fletch Embodiment of the Arrow Supported Fletching Jig

In FIGS. 1, 2, 6, 7, and 8, the three fletch embodiment 24 of the arrow held fletching jig 22 is illustrated. As shown in FIGS. 1, 2, 6, and 7, an arrow lower end cap 46, also referred to as a nock locator cap 46 or nock end cap 46, is positioned upright on a level surface 44, which may be quite small in area. In the central interior 48 of the lower end cap 46, at the center in the bottom is an upstanding nock locator 50, pin 50, tab 50, or rib 50, over which the nock 36 at the nock end 34 of an arrow 30 is placed, as an arrow 30 is positioned upright.

As shown in FIG. 6, the central interior 48 of the lower end cap 46, has three alike sides 52 sloping inwardly and downwardly, which are referred to as the tapered sides 52. As shown in FIG. 7, there is a small arrow 53 inscribed on the nock locator cap 46, to indicate the cock fletch position.

Figure 8:
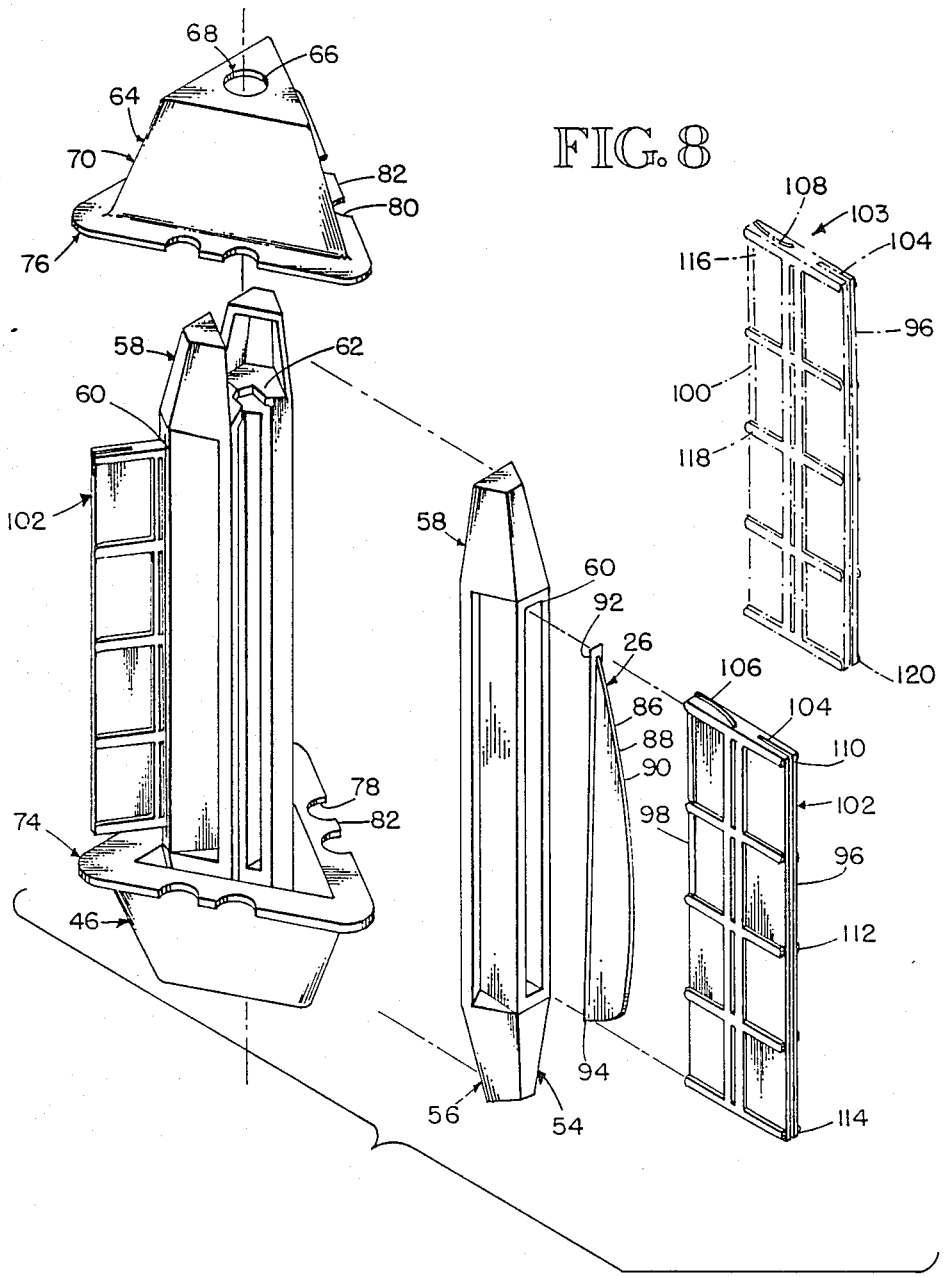
FIG. 8 is a partially exploded perspective view of the components of the arrow supported fletching jig, not showing the arrow, but showing the end caps, the clamp receivers for receiving the full lengths of the clamps, in turn receiving the full lengths of the fletching material, and in phantom lines showing another component, i.e. a fletching material clamp having a different direction helical groove, i.e. a left helical groove, which could be used in place of the right helical groove fletching material clamp.

In this three fletch embodiment 24, as shown in FIG. 8, three clamp receivers 54 are available, each having tapered bottom ends 56 and tapered top ends 58, referred to as the tapered ends 59, with the tapers matching the tapers of the tapered sides 52 of the lower end cap 56. Also each clamp receiver 54 has a central radially directed elongated clamp receiving slot 60 , which receives the entire length of a clamp, as a portion of the width of each clamp with fletching material, held fully in place, is fully passed into this receiving slot 60. All the clamp receivers 54 have this elongated radial pass through entire length clamp receiving slot. In addition, each clamp receiver 54, has vee shaped slots 62 in the interior, one near the top and another near the bottom thereof, which contact arrow shafts 28 of different diameters, which are selected to be uprightly mounted in the lower end cap 46, also called the nock locator cap 46.

As shown in FIG. 8, the three clammp receivers 54 are positioned about an arrow shaft 28, and while being positioned, their tapered surfaces of the tapered ends 56, 58 are matched to the tapered surfaces of the tapered sides 52 of the nock locator cap 46. Also their vee slots 62 are equally located about the arrow shaft 28.

While these components are so retained in position, the top end cap 64, also referred to as the pointed end cap 64, is moved down the arrow shaft 28, as the arrow shaft is cleared through the central hole 66, into contact with three clamp receivers 54. The top end cap 64 has a central interior 68 of three alike tapered sides 70 sloping inwardly and upwardly, which fit down over the tapered top ends 58 of the three clamp receivers 54.

When a compression force is applied in alignment with the arrow shaft 28 against the top end cap, then this force is counteracted by the lower end cap which is supported on the small level surface 44. As a consequence, the subassembly 72 of three clamp receivers 54, the lower end cap 46, the top end cap 64, and the arrow shaft 28 is tightened. The tapered surfaces are rough, which enhances this tightening and holds this arrow held fletching jig 22 together.

Also the lower end cap 46 and the top end cap 64 have surrounding flanges 74, 76. Each flange 74, 76 has three pairs of curved spaced notches 78, 80 and three tabs 82 formed between the spaced notches 78, 80. By using elastic bands 84 stretched between the tabs 82 of the top end cap 64 and the lower end cap 46, all of these components of the subassembly 72 are continually held together during an intended assembly time.

During the arrangement steps of moving the components of the subassembly 72 together, if a metal arrow shaft 28 is part of the subassembly 72, slight counterrotations of the lower end cap 46 and the top end cap 64 are undertaken to center the clamp receivers about the metal arrow shaft 28 and to obtain a better fit between the respective tapering surfaces. When a wood arrow shaft 28 is part of the subassembly 72, only the aligned compression force is used to reach the tightened positions of the components of the subassembly 72. Also when a wood arrow shaft 28 is receiving fletches 26, this arrow held fletching jig 22 is held together also by using the elastic bands 84.

As shown in FIG. 8, fletching material 86 made of plastic, feathers, rubber, or foil, is contoured in a conventional profile 88, having a continuous curved free edge 90, and a straight wider edge 92. The latter edge 92 is to be secured to an arrow shaft 28, by using a waterproof adhesive 94. The fletching material 86 so prepared and later secured to an arrow shaft 28 is then designated as the fletch 26, a feather 26, or a vane 26. When the fletching material 86 is feathers, then the clamps 102 or 103 have wider grooves 104, 106, or 108, than when plastic materials are being used to create the fletches 26.

To accurately position each feather or vane 26, each one 26 throughout its length is fitted to one respective side 96 or the other respective side 98 or 100 of a clamp 102 or 103, in either a straight groove 104 in respective sides 96, a right helical groove 106 in side 98, or a left helical groove 108 in side 100.

Figure 9:
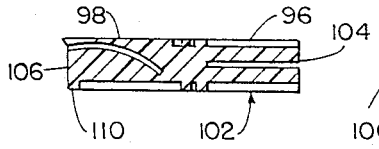
FIG. 9 is a cross sectional view, taken along line 9—9 of FIG. 8, indicating how this fletching material clamp has a right helical groove along one edge portoin thereof, and a straight groove along the other edge portion thereof, which, depending on one's choice, holds fletching material shaped as a fletch and held either in a right helical pattern or a straight pattern during the adherence of the particular fletch to the shaft of an arrow.
Figure 10:
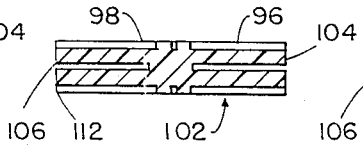
FIG. 10 is a cross sectional view, taken along line 10—10 of FIG. 8, indicating how the fletching material clamp, shown in FIG. 9, appears near or at the mid section, where the grooves in cross section appear alike, as though both were straight groove.
Figure 11:
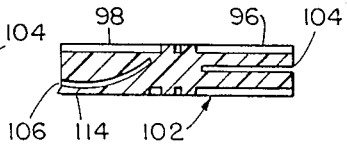
FIG. 11 is a cross sectional view, taken along line 11—11 of FIG. 8 indicating how the fletching material clamp, shown in FIGS. 9 and 10, appears nearer the bottom thereof, in respect to the right helical groove along one edge portion thereof, and a straight groove along the other edge portion thereof.

In FIGS. 9, 10, and 11, the top portion 110, the mid portion 112, and the bottom 114, of a clamp 102 are illustrated to show how the straight groove 104 remains straight on side 96, and a right helical groove 106 changes on side 98. In FIGS. 12, 13, and 14, top portion 116, mid portion 118, and the bottom portion 120 of another clamp 103, shown in phantom lines in FIG. 8, are illustrated to show how the straight groove 104 remains straight on side 96, and a left helical groove 108 changes on side 100.

As shown in FIG. 15, after a selected clamp 102 or 103 is decided upon, and after one of its respective grooves 104, 106, or 108 is decided upon, then a fletch 26 is almost fully inserted in a respective groove, leaving only the straight wider edge 92 exposed to receive the adhesive 94. Two other fletches 26 are so inserted in two other clamps 102 or 103. The adhesive 94 is then applied to the initially straight wider edge 92, and each combined fletch 26 and clamp 102 or 103 is inserted, as shown in FIGS. 2 and 16, into a central slot 60 of a clamp receiver 54, placing the adhesive covered wider edge 92 of the vane 26 accurately in place against the shaft 28 of the arrow 30, and so holding the fletch 26 in place in the respective selected form, straight, right helical, or left helical, until the adhesive cures sufficiently so the fletch will remain in place.

When the curing time has been sufficient, the disassembly of this arrow held fletching jig 22, in respect to this three fletch embodiment 24, is undertaken by removing the clamps 102 or 103, raising the top end cap 64 clear of the clamp receivers 54, and the arrow 30, radially spreading apart the top tapered ends 58 of the clamp receivers, and upwardly withdrawing the shaft 28 of the arrow 30, now with the fletches 26 secured accurately in place. If another arrow shaft 28 is ready, the selected shaft 28 is lowered in place, and the subassembly 72 is reassambled, and the steps are continued to complete the fletching of another arrow 30. If the fletching operations are to be discontinued for a while, the components may be separated or kept together until the next fletching time, and conveniently carried and/or stored.

The Four Fletch Embodiment of the Arrow Supported Fletching Jig, Using 90 Degree Arc Spacing In FIGS. 17 and 18, a four fletch embodiment 38 is illustrated of an arrow held fletching jig 22. There are similarly functioning components, some of what are proportioned differently to arrange for the spacing and accurate securement of four fletches 26 about an arrow shaft 28, at equal spaces determined initially on ninety degree arcs in making the fletch jig components. The lower end cap 122 and the upper or top end cap 124 are changed to have four sloping or tapered interior sides. There are four clamp receivers 128, having like tapered exterior and sides. The same clamps 102 and 103 are used, and the same provisions are made for utilizing elastic bands 84. Preferably, all the tapered sides have a rough surface.

Figure 2:
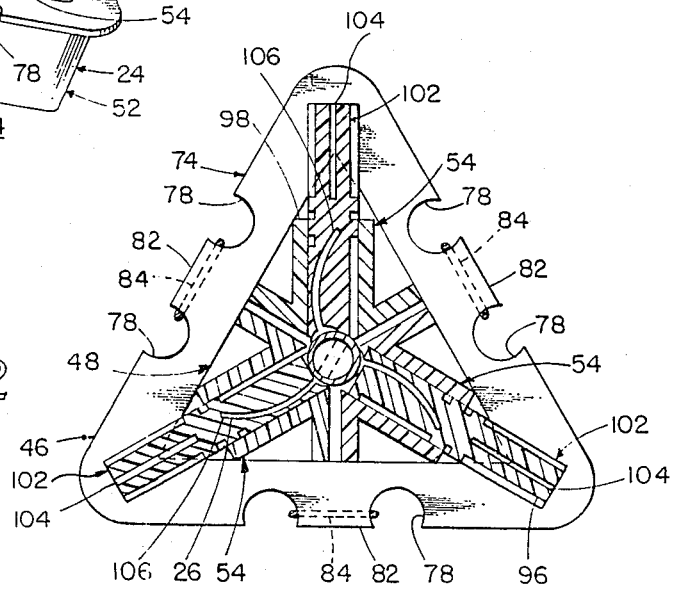
FIG. 2 is a cross sectional view taken on line 2—2 of FIG. 1 looking down toward the bottom of the arrow held fletching jig.

The Four Fletch Embodiment of the Arrow Supported Fletching Jig, Using 105 Degree Arc, and 75 Degree Arc Spacing In FIG. 19, a view similar to FIGS. 2 and 18, illustrates another four fletch embodiment 40 of an arrow held fletching jig 22. There are similarly functioning components, some of which are proportioned differently to arrange for the spacing and accurate securement of the four fletches 26 about an arrow shaft 28, at two equal spaces, each determined by a 75 degree arc, and at two equal spaces, each determined by a 105 degree arc, in making the fletch jig components. The four clamp receivers 132 are made differently as shown, so their central clamp receiving slots 60 are centered at the respective angled locations. Essentially the other components remain as shown in FIGS. 17 and 18. The use of this embodiment 40 follows the procedures discussed in reference to the use of the embodiments 24 and 38, in accurately positioning fletches 26 on the shafts 28 of arrows 30.

The Hand Made Prototype of the Arrow Supported Fletching Jig

In FIG. 20, one prototype 132 of three fletches is illustrated with respect to two hand made prototypes, one for three fletches, one for four fletches, of an arrow supported fletching jig 22 which were made at the outset. The making and using of these prototypes served as the basis for proceeding on with the design, assembly, and use of molded components of an arrow supported fletching jig 22, as shown in FIGS. 1, 17, and 19.

In this partially exploded view of FIG. 20, a hollow cylindrical tube 134 of reasonable wall thickness is shown positioned over and beyond the end of an arrow shaft 28, in respect to the undivided end portion 136 of this tube 134. The balance 138 of this tube 134 is cut away to create the clamp receivers 140 with their clamp receiver slots 142. The cutting is done so the clamp receivers 140, when later being used in the jig 132, are radially angled apart to clear the accurately positioned fletches 26. At the outset of a fletching operation, the clamp receivers 140 are held radially together by using an end positioned lock ring 144. One of the clamp receivers 140 has a pin, tab, rib, or tong, not shown, to be fitted into the nock 36 of an arrow 30, at the start of a fletching operation.

This prototype 132 utilized the same type of clamps 102 having on one side 96 a straight groove 104, and the other side 98 or 100, having a right helical groove 106 or a left helical groove 108. The fletches 26 had their initially straight wider edge 92 of the fletching material 86 covered with adhesive after being inserted in the clamp 102. Thereafter the clamp 102 with the fletching material 86, was pressed into the slot 142. This same procedure continued to be used in respect to the arrow supported fletching jigs 22 made of molded parts as shown in FIGS. 1, 8, and 17.

An arrow held fletching jig 22, could be made, wherein the overall integral end of the clamp receives like clamp receivers 140, would be located at the nock end 34 of the arrow 30, and their radially expandable ends would be directed toward the pointed end 32 of the arrow 34. There wold be a nock locator pin, rib, or tong 50 in the integral end.

Preferably, the radially expandable ends, whereever used are tapered to better receive a lock ring, which is also tapered.

All the arrow supported fletching jigs 22 are completely portable, allowing arrow fletching anywhere there is a flat surface for the vertical or horizontal placement of these jigs 22. Thus the archer may even fletch arrows in the field with equally fine results in accuracy, precision, and speed.

I claim:

1. A portable arrow supported fletching jig for use anywhere there is a flat surface, to accurately place all fletches on an arrow shaft during a complete overall operation, involving essentially just one adhesive curing time, comprising:

(a) clamp receivers, each having an elongated radial pass through entire length clamp receiving slot, and an inside central longitudinal arrow shaft receiving space, to be arranged together about an arrow shaft, where fletches are to be accurately securted to an arrow;

(b) means to keep the clamp receivers arranged together about an arrow shaft; and (c) clamps, each having at least one elongated entire length receiving slot to receive an entire length of fletching material, which is previously pre-shaped into a fletch, and also the length of each being entirely receivable in an elongated radial pass through entire length clamp receiving slot of a clamp receiver;

whereby, when fletching material pre-shaped into a fletch, is positioned throughout the entire length thereof in an entire length receiving slot of a clamp, and then portions thereof are covered with an adhesive, and thereafter the combined clamp and fletch are radially moved through the entire length clamp receiving slot of a clamp receiver into contact with a shaft of the arrow, and so held for a sufficient curing time, then the fletch will be accurately positioned on the arrow shaft, and this placement and securement may be underaken at the same time other fletches are being so accurately secured, whereby all the fletches are secured, to an arrow shaft in a complete overall operation involving essentially just one adhesive curing time.

2. A portable arrow supported fletching jig, as claimed in claim 1, wherein, each clamp has an additional elongated entire length receiving slot, whereby one of these elongated entire length receiving slots is a straight slot and the other is a helical slot, to be used alternatively.

3. A portable arrow supported fletching jig, as claimed in claim 2, wherein the helical slot is a right helical slot.

4. A portable arrow supported jig, as claimed in claim 2, wherein the helical slot is a left helical slot.

5. A portable arrow supported jig, as claimed in claim 1, wherein the means to keep the clamp receivers arranged together aobut an arrow shaft comprises a point end cap and a nock end cap for axial placement over the ends of the clamp receivers, to insure the arrangement of these clamp receivers about the shaft of the arrow, which is then so supporting this portable arrow fletching jig.

6. A portable arrow supported jig, as claimed in claim 5, wherein the ends of the clamp receivers and the point end and nock end caps have like angled interfitting tapered surfaces to further insure the aligned arrangemnt of this portable arrow supported jig on and about the shaft of an arrow.

7. A portable arrow supported jig, as claimed in claim 6 wherein the nock end cap has a centered nock locator to receive a nock of an arrow.

8. A portable arrow supported jig, as claimed in claim 7, wherein the point end cap has a centered hole to receive the shaft of an arrow.

9. A portable arrow supported fletching jig for use anywhere there is a flat surface, to accurately place all fletches on an arrow shaft during a complete overall operation, involving essentially just one adhesive curing time, comprising:

(a) clamp receivers, each having an elongated radial pass through clamp receiving slot, like tapered upper and lower end surfaces, and an inside central longitudinal arrow shaft receiving space, to be arranged together about an arrow shaft, where fletches are to be accurately secured to an arrow;

(b) clamps, each having an elongated receiving slot to receive fletching material, which is previously contoured into a fletch, and also each being receivable in an elongated radial pass through clamp receiving slot of a clamp receiver; and (c) a point end cap and a nock end cap having like tapered surfaces to interfit with the like tapered upper and lower end surfaces of the clamp receivers to insure the aligned arrangement of the clamp receivers about the shaft of an arrow, which is then so supporting this portable arrow fletching jig.

10. A portable arrow supported fletching jig, as claimed in claim 9, wherein the nock end cap has a centered nock locator to receive a nock of an arrow, and the point end cap has a centered hole to receive the shaft of an arrow.

11. A portable arrow supported fletching jig, as claimed in claim 10, wherein the nock end cap and the point end cap both have receiving tabs to receive respective portions of elastic bands, and in addition, elastic bands which are to be stretched between these receiving tabs to axially keep the nock end cap and the point end cap biased toward each other, while the clamp receivers are arranged together about an arrow shaft and so held by the nock end cap and the point end cap.

12. A portable arrow supported jig, as claimed in claim 9, wherein the tapered surfaces of the clamp receivers, and the tapered surfaces of the point end cap and the nock end cap have rough surfaces, which, when closely interfitted, hold the components of the portable arrow supported fletching jig together.

13. A portable arrow supported jig, as claimed in claim 11, wherein the tapered surfaces of the clamp receivers, and the tapered surfaces of the point end cap and the nock end cap have rough surfaces, which when closely interfitted, also help hold the components of the portable arrow supported fletching jig together.

14. A portable arrow supported fletching jig, as claimed in claim 9, wherein the elongated receiving slots of the clamps are sized to receive fletching feather material.

15. A portable arrow supported fletching jig, as claimed in claim 9, wherein the elongated receiving slots of the clamps are sized to receive fletching plastic material.

16. A portable arrow supported fletching jig for use anywhere there is a flat surface, to accurately place all fletches on an arrow shaft during a complete overall operation, involving essentially just one adhesive curing time, comprising:

(a) clamp receivers, each having an elongated radial pass through clamp entire length receiving slot, and an inside central longitudinal arrow shaft receiving space, to be arranged together about an arrow shaft, where fletches are to be accurately secured to an arrow;

(b) clamps, each having at least one elongated entire length receiving slot to receive an entire length of fletching material, which is previously pre-shaped into a fletch, and also the length of each being entirely receivable in an elongated radial pass through entire length clamp receiving slot of a clamp receiver;

(c) wherein the clamp receivers have a common integral end adapted to be placed at the nock end of an arrow, and radially movable ends adapted to be placed toward the point end of an arrow, when this portable arrow supported fletching jig is to be mounted on the shaft of an arrow; and (d) a lock ring adapted for axial movement over the radially movable ends of the clamping receivers to hold them centered about an arrow shaft;

whereby, when fletching material pre-shaped into a fletch, is positioned in a slot of a clamp, and then portions thereof are covered with an adhesive, and thereafter the combined clamp and fletch are radially moved through the clamp receiving slot of a clamp receiver into contact with a shaft of the arrow, and so held for a sufficient curing time, then the fletch will be accurately positioned on the arrow shaft, and this placement and securement may be undertaken at the same time other fletches are being so accurately secured, whereby all the fletches are secured, to an arrow shaft in a complete overall operation involving essentially just one adhesive curing time.

17. A portable arrow supported fletching jig, as claimed in claim 16, wherein the common integral end adapted to be placed at the nock end of an arrow has a nock locator pin.

18. A portable arrow supported fletching jig, as claimed in claim 17, wherein the lock ring is tapered, and the radially movable ends of the clamp receivers are tapered to improve their interfitting with one another.

19. A portable arrow supported fletching jig, as claimed in claim 16, wherein the lock ring is tapered, and the radialy movable ends of the clamp receivers are tapered to improve their interfitting with one another.

* * * * *